US005217535A

United States Patent [19]

Hultzsch et al.

[11] Patent Number: 5,217,535

[45] Date of Patent: Jun. 8, 1993

[54] COATING DEVICE FOR CAST-COATING WEBS

[75] Inventors: Guenter Hultzsch, Wiesbaden; Gerald Schuetze, Hofheim; Hermann Idstein, Oestrich-Winkel, all of Fed. Rep. of Germany

[73] Assignee: Hoechst Aktiengesellschaft, Frankfurt am Main, Fed. Rep. of Germany

[21] Appl. No.: 827,455

[22] Filed: Jan. 29, 1992

[30] Foreign Application Priority Data

Feb. 7, 1991 [DE] Fed. Rep. of Germany ..... 4103710

[51] Int. Cl.[5] ..... B05C 5/00

[52] U.S. Cl. ..... 118/324; 118/325; 118/DIG. 4

[58] Field of Search ..... 118/312, 324, 325, DIG. 4

[56] References Cited

U.S. PATENT DOCUMENTS 3,074,374 1/1963 Buerkle ..... 118/324

5,063,874 11/1991 Dodds et al. ..... 118/60 Z

FOREIGN PATENT DOCUMENTS 1181096 11/1964 Fed. Rep. of Germany .

1235970 7/1960 France .

501436 2/1971 Switzerland .

*Primary Examiner*—W. Gary Jones

*Assistant Examiner*—Charles K. Friedman

*Attorney, Agent, or Firm*—Foley & Lardner

[57] ABSTRACT

A coating device for cast-coating webs and plates or the like comprises a swivelling casting channel with a cover and a draining trough connected with a supply tank for a coating material through a return line. A suction line leads from the supply tank, via a pump and a hose, to a supply pipe which is inserted in a connecting piece of the casting channel and opens into the interior of the casting channel. An overflow baffle and an underflow baffle are inserted in mountings or grooves, respectively, inside the casting channel. A gap is left open between the cover and the casting channel, through which gap the coating material flows over an overflow edge onto a casting plate which is attached to the outside of the casting channel and points vertically downward. The casting film flows upon the plates or webs conveyed horizontally through the coating device.

19 Claims, 5 Drawing Sheets

COATING DEVICE FOR CAST-COATING WEBS

BACKGROUND OF THE INVENTION

1. Field of the Invention

The present invention relates to a coating device. More specifically, the present invention is directed to a coating device for cast coating webs, plates or the like, comprising a coating material supply tank and a pump for pumping coating material from the supply tank through a hose into a supply pipe which opens into a casting channel.

2. Description of the Prior Art

Cast coating is typically carried out in the form of a curtain coating, whereby coating material is conveyed downward through a slot die of a coating head, and upon emerging from a narrow die gap, the coating material is pulled down by gravity and forms a curtain.

In another known coating device, commonly known as a "sliding surface coater", the coating material is conveyed upward through a duct and flows down an inclined surface. At a breaking edge of this inclined surface, the coating material forms a curtain which coats a substrate as it is transported past the coater.

In other known coating devices, coating material flows through a vat out of which it is scooped by means of a rotating roll. A metering blade provided adjacent the rotating roll shaves the coating material off the rotating roll, and the shaved coating material flows down an inclined surface to an edge of the inclined surface, where the coating material is pulled down by gravity and forms a cast curtain.

All of these coating devices use narrow gaps to produce the coating film, the cleanliness and precision of which have a considerable influence on the resulting coating. After the casting operation, the casting heads of these coating devices must, in general, be cleaned very thoroughly to prevent coating residues from drying up and hardening which could give rise to faults in the curtain when the coating devices are started again. For this purpose, the slot dies of the casting heads must be opened or cleaned from the inside using large quantities of solvents and diluents. This procedure requires considerable expenditure in terms of manpower and time and consumes large amounts of solvents and detergents, which must be recovered in an ecologically acceptable process and stored. In practice, cleaning of the coating devices is often avoided by keeping the coating line in operation round-the-clock, even when it is not used for production, for example overnight. In such a case, however, the solvent evaporating from the coating material must be continuously replenished, which means that this way of proceeding is cost-intensive and hardly economical.

To keep down-times due to cleaning operations on the coating devices as short as possible, the component parts of coating devices, which must be cleaned, are often exchangeable. For cleaning purposes, the casting heads and coating material containers can then be exchanged, for example, if a different coating material is to be used. The cleaning of casting heads and other component parts of the coating devices is then carried out remote from the coating line.

Curtain coating is used, among others, to apply photosensitive solder stop resists to circuit boards or to apply liquid galvano or etch resists to support materials. The photosensitive solder stop resists are usually two-component systems comprising a resist material and a hardening agent that hardens after a certain period of time. This means that regular and proper cleaning of the coating device is particularly important in order to keep the coating device always ready for operation.

SUMMARY OF THE INVENTION

It is an object of the present invention to provide a coating device, in which contamination and blockage, which may lead to interruptions of the coating process, are generally prevented and in which cleaning can be carried out in a particularly simple and time-saving operation.

According to the present invention, these and other objects are achieved by a coating device wherein a casting channel comprises a tube cut-open in the form of a bowl and closed by lateral end faces, which tube is disposed on a mounting support and can be swivelled about a bearing close to an overflow edge of the casting channel and wherein a dish-shaped cover, which can be swivelled about a further bearing, covers the casting channel in its working position to leave only a gap in the area of the overflow edge.

In one embodiment of the present invention, an overflow baffle and an underflow baffle which encloses a flow-through slot with an inner side of the casting channel are disposed in grooves in the interior of the casting channel to separate air bubbles from the coating material.

The embodiment of the present invention also comprises a casting plate having an edge-shaped casting lip, which is disposed in a fixing device on the outside of the casting channel below the overflow edge. The casting plate is made of a magnetic material and is held in place by magnets attached to the outside of the casting channel.

The present invention offers the advantage that the casting channel is in the form of an overflow channel which is pivotally attached, such that the casting channel can be emptied without having to open or dismantle any component parts. Cleaning operations present no problems because the casting channel does not exhibit any narrow crevices or other inaccessible places where coating residues usually harden up and are then very difficult to remove. For cleaning, the casting channel can be taken out of its mounting support, without having to unscrew any tube or hose coupling through which the coating material flows into the casting channel. After removing the casting channel for cleaning purposes, a clean casting channel can be mounted in the mounting support, and the coating operation can be continued with only a very short time interval of down time.

According to the present invention, there is provided a coating device comprising a coating material supply tank, a casting channel having a cover, a supply tube communicating with the casting channel, a drainage trough, and a pump operatively associated with the coating material supply tank and the supply tube for pumping the coating material from the coating material supply tank to the supply tube, wherein the casting channel comprises an open tubular section having an overflow edge and closed ends to form a bowl, disposed on a support for swivel movement about an axis of the tubular section, the drainage trough being provided beneath the overflow edge, wherein the cover is disposed on a support for swivel movement about the axis of the tubular section, and the cover and the tubular section form a gap adjacent the overflow edge of the tubular section, and wherein the drainage through is connected to the coating material supply tank.

DETAILED DESCRIPTION OF THE PREFERRED EMBODIMENTS

Figure 1:
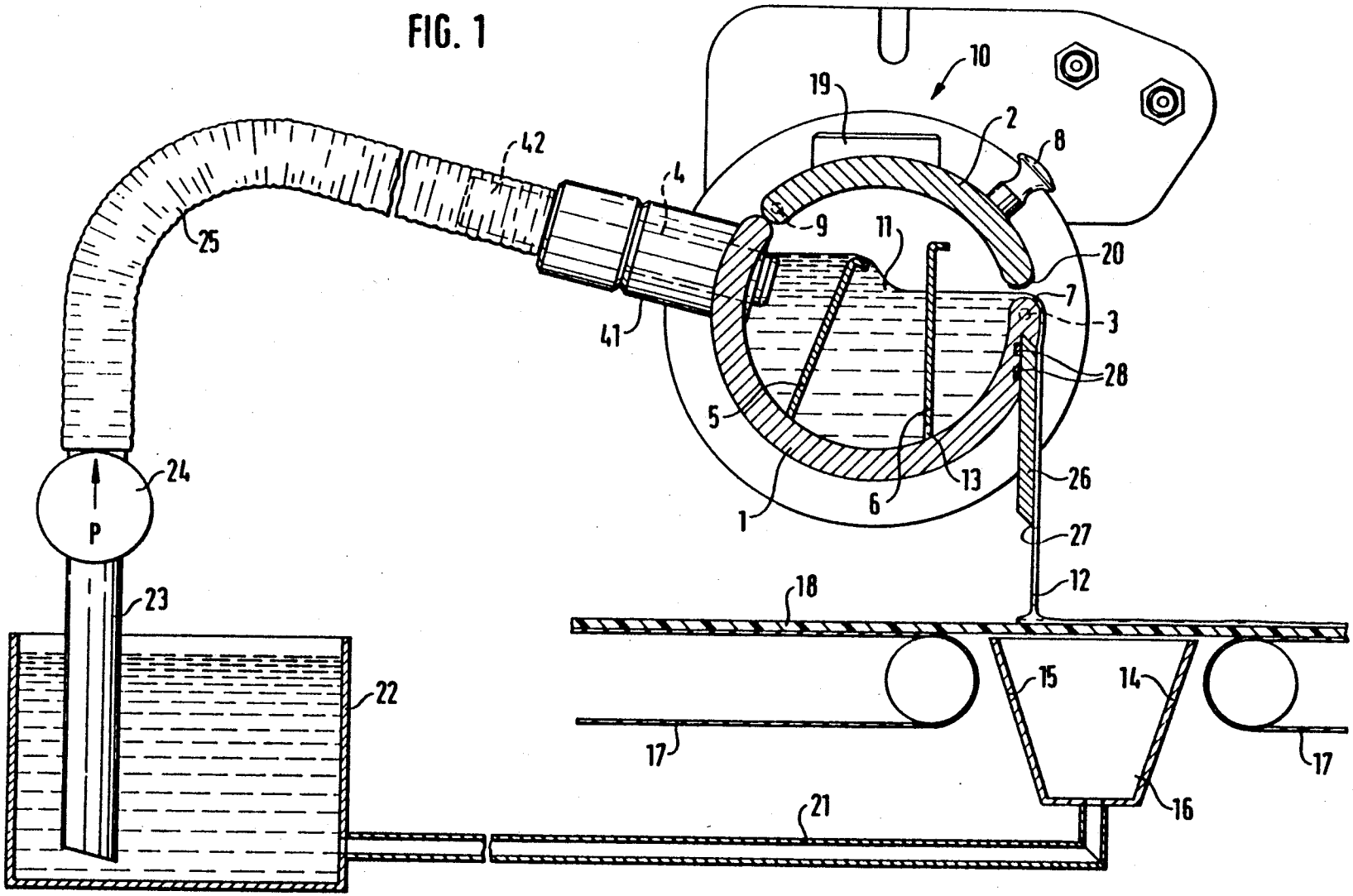
FIG. 1 is a side, elevational, diagrammatic view of a coating device of the present invention, showing a casting channel, draining trough, supply tank and pump in section.

Referring to FIG. 1, a coating device is shown in a diagrammatic view, with a casting channel 1 being in its working position. Inside the casting channel 1 there are an overflow baffle 5 and an underflow baffle 6 which encloses a flow-through slot 13 with the inner side of the casting channel 1. The overflow baffle 5 and the underflow baffle 6 are mounted in grooves of the casting channel 1. The casting channel 1 comprises a tube which has been cut-open obliquely in the form of a bowl and is closed by lateral end faces 29, 30. The end faces 29, 30 are connected to the casting channel 1 by means of screws 59, 60. The casting channel 1 is held in a mounting support 40 comprising two bearing plates 49, 50 and can be removed from this mounting support, as will be described in detail below. A swivelling dish-shaped cover 2 covers the casting channel 1 in its working position to leave only a gap in the area of the overflow edge 7. The cover 2 can be swivelled about two bearings 9 and has a knob 8 on its outside, which permits handling of the cover. A bearing 9 each is provided in the end faces 29, 30 of the casting channel 1. Each of these bearings is engaged by a swivelling half-axis which protrudes laterally from the cover 2. The casting channel 1 can be swivelled about two bearings 3 provided close to the overflow edge 7, from its working position into one of two cleaning positions. At its end facing the overflow edge 7, the cover 2 is provided with a gasket 20 which ensures that the casting channel 1 is tightly shut-off by the cover 2. If the entire casting channel 1 together with its cover 2 is to be tilted, the cover 2 tightly seals the casting channel 1.

A quantity of the coating material 11 to be applied, which is present in the casting channel 1, is conveyed from a supply tank 22 through a suction line 23, a pump 24, a hose 25 and a supply tube 4 into the casting channel 1. The supply tube 4 is inserted into a connecting piece 41 on the outside of the casting channel 1. The connecting piece 41 has a funnel 42 over which the hose 25 is pushed. In order to remove the casting channel 1 from the mounting support 40 for carrying out cleaning operations it is only necessary to withdraw the supply tube 4 from the connecting piece 41. Further dismantling is not required.

A casting plate 26 with an edge-shaped casting lip 27 is disposed on the outside of the casting channel 1 below the overflow edge 7. When the casting channel 1 or the coating device 10, respectively, is in its working position, the casting plate 26 extends vertically. The casting plate 26 is appropriately made of a magnetic material, for example, stainless steel or any other alloy steel and is held in place by magnets 28 attached to the outside of the casting channel 1.

The casting channel 1 levels the coating material supplied over the width of the casting plate 26, since cross-currents and wave motions are prevented at the overflow edge 7. The casting channel 1 forms an inlet and a steady-flow region for the coating material, which makes it possible to employ even pulsating pumps 24, for example hose or diaphragm pumps, by means of which abrasive coating materials, such as varnishes, are particularly readily delivered. The coating material is fed into the casting channel by the pump 24, through the hose 25 and the supply tube 4, as described above. The supply tube is inserted obliquely from above into the connecting piece 41 of the casting channel 1 and can be removed from this connecting piece, without detaching any screw coupling. It is thus possible to place the coating material hose 25 to be cleaned into the supply tank 22 and remove coating material residues from the hose by rinsing with a detergent within the supply tank. Even if the hose 25 is not intended to be cleaned, the end of the hose 25, which has been removed from the funnel 42 of the connecting piece 41, is advantageously placed into the supply tank, because solvents then cannot escape from the hose into the environment, but are rather absorbed by the coating material in the supply tank 22. Compared with other known coating devices or cast coaters, respectively, pollution of the environment by evaporating solvent is drastically reduced. It is also an advantage of this closed cycle of the coating agent that the coating material, which is usually in the form of a two-component system, can be circulated and mixed in the supply tank 22 via the pump 24 and the suction line 23. Mixing in this manner can also be carried out when diluting the coating material, without the risk of coating materials of different viscosities entering into the casting channel 1 and thus also into the cast curtain. A special stirring or mixing element, which is usually integrated into the varnish supply tanks of curtain casting installations, is therefore not required. In addition, cleaning of the coating device 10 is facilitated, since the coating material can be pumped from the closed-circuit system into another supply tank, without the use of a three-way tap. In the same manner, rinsing can be carried out by circulating a detergent.

The overflow edge 7 levels the casting film 12 in the direction of the vertical casting plate 26. In its working position, the casting channel 1 is horizontally aligned. To achieve this, the casting channel 1 rests on at least one side on an adjusting unit (not shown), for example, in the form of a fine-thread spindle or a draw wedge. For simple adjustment, the coating device 10 is equipped, for example, with a water balance 19 in the area of the cover 2.

The casting film 12 flows vertically downward over the casting plate 26 and makes contact with a substrate 18, for example, a circuit board or a web. The substrate 18 is moved past the coating device 10 by means of two conveyer belts 17 arranged side by side. Between the two conveyer belts, which run endlessly over rollers, a draining trough 16 with inclined run-off walls 14, 15 is provided underneath the substrate passage to collect coating material which runs down from the casting plate between two circuit boards or behind a passing web end or flows down over the sides of the circuit board or the web. The draining trough 16 is connected to the supply tank 22 by a return line 21 so that the coating material circulates in a closed cycle which ensures that coating material neither escapes into the environment nor is lost to further processing.

Figure 2:
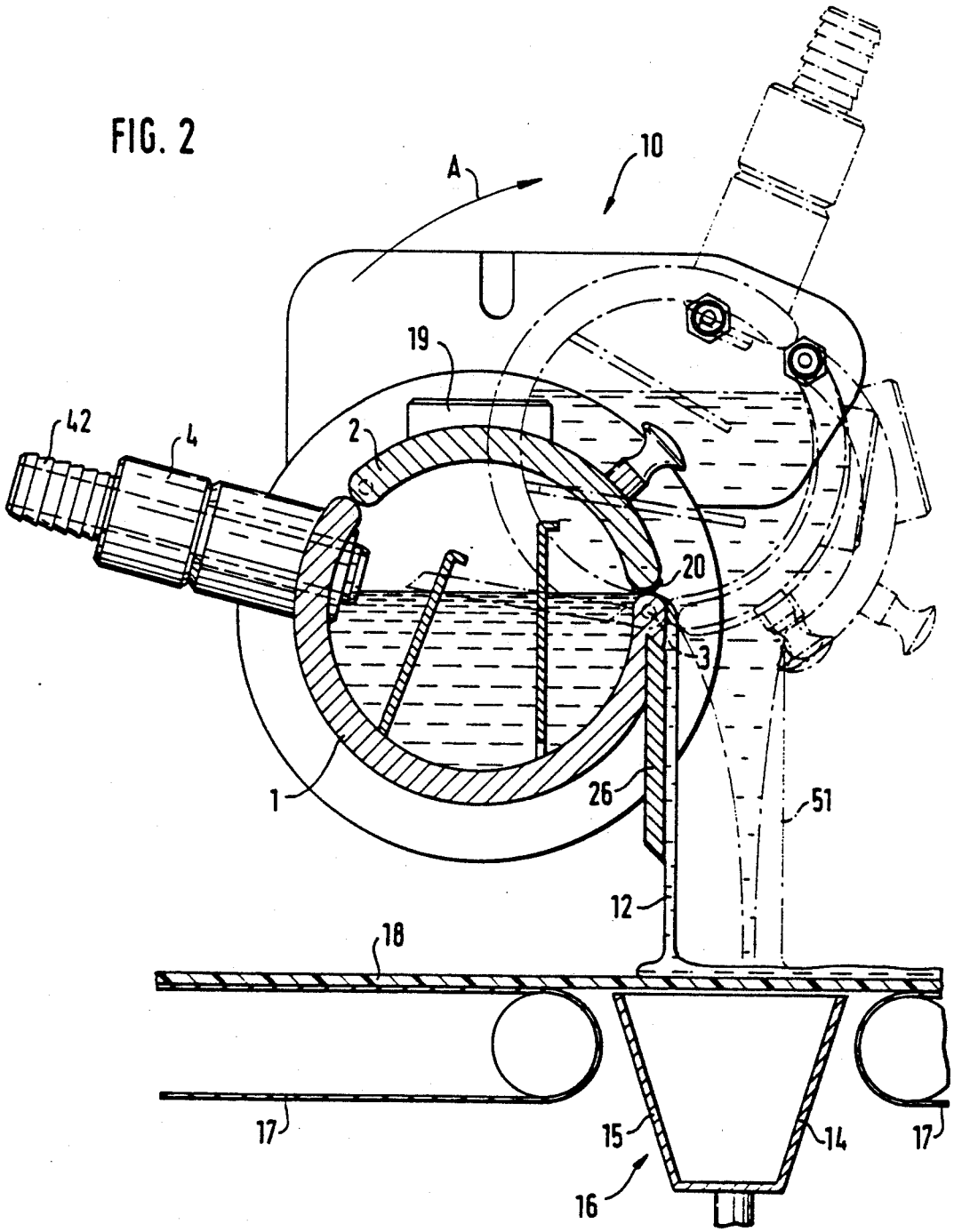
FIG. 2 is a side, elevational, sectional view of the casting channel shown in FIG. 1, wherein the coating device is shown in its operating and cleaning position.

FIG. 2 shows the working position of the casting channel 1 in solid, continuous lines and shows the first cleaning position of the casting channel 1 in broken lines. For the sake of clarity, the other component parts of the coating device, such as the supply tank, the pump and the hose for the coating material, are omitted. As already mentioned above, the casting channel 1 can be swivelled about the bearings 3 located close to the area of the overflow edge 7. Before the casting channel 1 is swivelled to adopt the cleaning position as shown in broken lines, the cover 2 is locked in a tight-closing position with the aid of the gasket 20 which rests snugly against the overflow edge 7. The hose 25 is then removed from the funnel 42 (see FIG. 1) and the casting channel 1 is tilted so that the overflow edge 7 is at the lowest point. In this cleaning position, the cover 2 is opened to form a gap, and the coating material runs off downward without dripping off from the casting plate which, in the cleaning position, points obliquely upward with respect to the horizontal line. To ensure easy draining of the coating material into the draining trough 16 the latter has inclined run-off walls 14 and 15 which prevent coating material or detergent from dripping onto the conveyer belts 17. Following complete draining of the coating material, the casting channel 1 is swivelled back into its working position and then removed from the mounting support and, for example, immersed into a closed tank containing a detergent. Both the working position and the two cleaning positions of the coating channel 1 are fixed by means of locking bolts 35, 36 and 45, 46 which penetrate the bearing plates 49, 50 of the mounting support 40 and holes provided in locking and fitting screws 33, 34 of the end faces 29, 30 and engage in stop holes 47, 48 (see FIG. 3).

FIG. 2 also shows the casting channel in a further cleaning position which is reached in such a way that the casting channel 1 is not locked in its first cleaning position, in which the coating material runs off downward, but is swivelled a bit further and locked in its second cleaning position by means of the locking bolts such that a vertically downward-pointing sheet 51 remains invariably in the area of the draining trough 16, but has a sufficiently great distance from the casting plate 26, when the casting channel is in its working position. When emptying the contents of the casting channel 1, coating material or detergent cannot drop onto the conveyer belts 17.

The run-off sheet 51 is attached by screws, a magnetic fastening or a plug connection and is consequently readily detached. The run-off sheet 51 can be made of, for example, a flexible material such as a plastic sheet or a metal foil. It is possible to fasten this foil, among others, to the back of the casting plate 26 and in the draining trough 16, which has the effect that, upon swivelling of the casting channel 1, the run-off sheet always points downward into the draining trough 16.

The casting channel 1 is designed to permit easy cleaning. To achieve this, the corners in the interior of the casting channel 1, which are wetted by the coating material, are rounded, and the inside wall surface of the casting channel 1 is smoothed, polished or coated with an appropriate material, for example a perfluorinated plastic. There are no cavities which normally give rise to drying-on, incrusting and soiling due to deposited particles.

The cover 2 of the casting channel 1 prevents solvents from evaporating. It may be made of glass, metal or a solvent-resistent plastic. For cleaning, the cover 2 is swung back about the bearings 9 and is then cleaned or dismounted and immersed into a cleaning bath. As already mentioned above, the cover 2 has the shape of a half-shell which, in the working position of the casting channel 1, is opened a few millimeters, only in the area of the overflow edge 7. For draining the contents of the casting channel 1 this narrow opening of the cover 2 is maintained and prevents coating material which flows off from the inside wall at the back of the casting channel 1 from dropping onto the conveyer belts 17.

Figure 3:
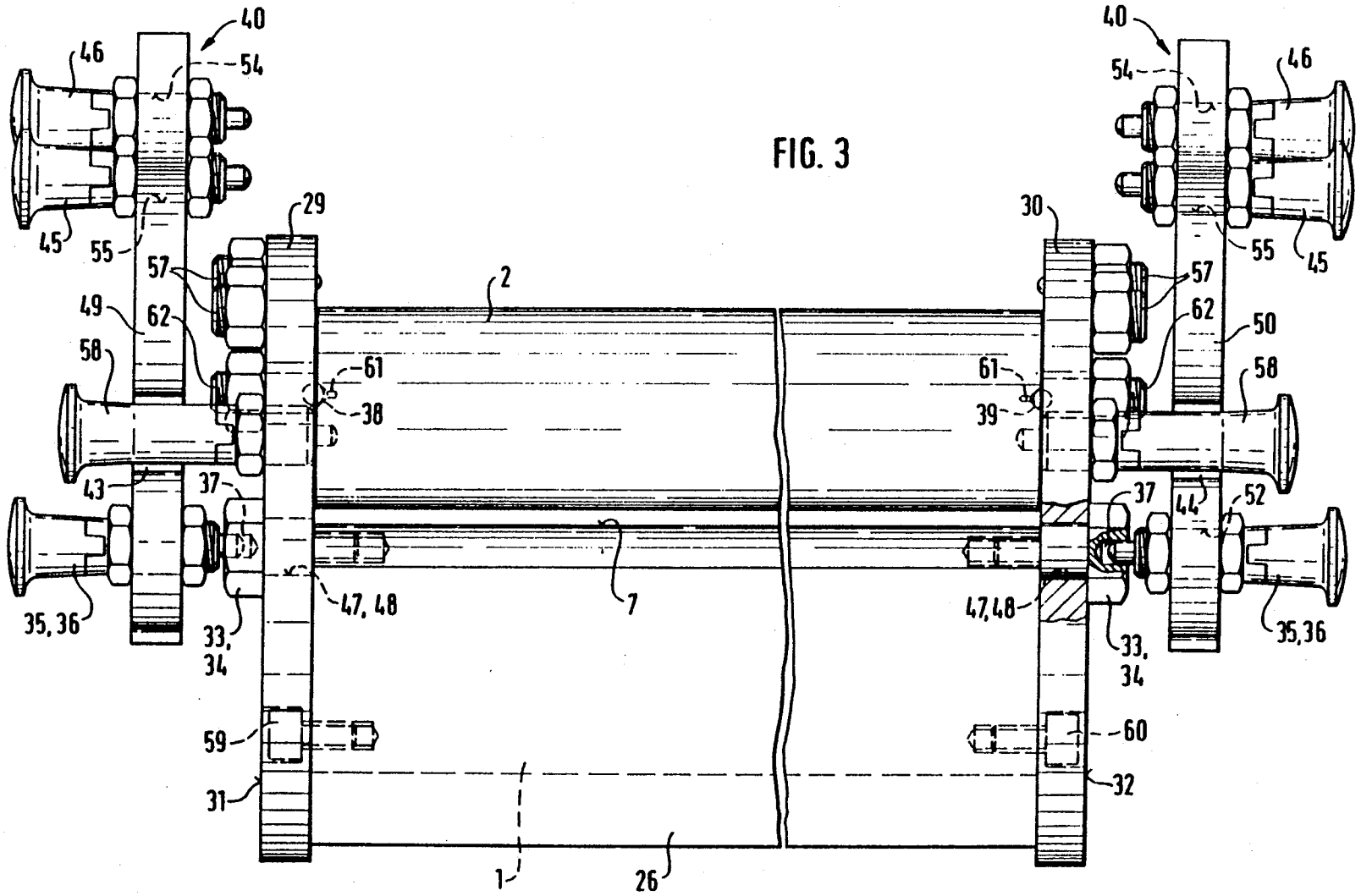
FIG. 3 is a front, elevational view in section showing a plurality of bearing plates of the mounting support of the casting channel and partially the casting channel.

As can be seen from FIG. 3, the lateral end faces 29, 30 of the casting channel 1 extend slightly beyond the tubular casting channel 1 and are provided on their outsides 31, 32 with locking and fitting screws 33 and 34 with holes 37 which are in alignment with stop holes 47, 48 in the end faces 29, 30. Four locking bolts each 35, 36 and 45, 46 are disposed on the outsides of the bearing plates 49, 50, which bolts penetrate the bearing plates 49, 50. The locking bolts 35, 36 and 45, 46 are, in general, arranged in pairs, i.e., each bearing plate is provided with two pairs of locking bolts, each locking bolt pair being aligned opposite one another in the bearing plates. Locking bolts 35, 36 are in a horizontal plane normal to the plane of the drawing, which means that the locking bolt 35 in front conceals the locking bolt 36 lying behind it. In the engaged state, the locking bolts penetrate the holes 37 of the locking and fitting screws 33, 34 and engage with the stop holes 47, 48 on the end faces 29, 30, such that the casting channel 1 is locked in its respective positions. When the locking bolts are disengaged or withdrawn, respectively, the casting channel 1 is no longer connected to the bearing plates and can be removed from the mounting support 40. In the working position of the casting channel 1, the locking bolts 35, 36 are in their common horizontal plane. The locking bolts 35 and 36, which are present in pairs, are then engaged in their respective stop holes 47 and 48.

The pair of locking bolts 36, 36 lying opposite one another in the bearing plates 49, 50 form, together with the stop holes 47, 48, in which they are engaged, the bearings 3 which act as centers of rotation for swivelling the casting channel 1 along a swivel path 56, relative to the stationary bearing plates. Before swivelling the casting channel 1, the cover 2 is tightly closed with the aid of locking bolts 58, 58 which lie opposite one another to form a pair. Then the locking bolts 35 are withdrawn from their stop holes 47 in the end faces 29, 30 and turned into their rest positions which are at an angle of 90° from the engaged positions. The locking bolts 58, 58 which are mounted on the outsides of the end faces 29, 30, penetrate the end faces and engage in lateral holes in the cover 2 to hold the cover 2 firmly against the casting channel 1 in sealing the cover, when the casting channel 1 is to be swivelled from its working position into one of its two cleaning positions. During the swivel movement of the casting channel 1, the locking bolts 58, 58 move through recesses 43, 44 in the bearing plates 49, 50. The recesses have the form of slot-shaped partial circumferences of circular arcs.

When the casting channel 1 has been swivelled into its first cleaning position, the pair of locking bolts 45, 45 are released and penetrate the holes 55, 55 in the bearing plates to engage in the stop holes 47 of the end faces 29, 30 through the respective locking and fitting screws, thus locking the still closed casting channel 1 in this position. The cover 2 is then unlocked by pulling back the locking bolts 58, 58 and turning them into their rest positions. The cover 2 is opened and fixed in a position, in which the gap formed between the casting channel 1 and the cover 2 has the same width as the gap existing during the casting operation, i.e., in the working position of the casting channel 1. To this end, pairs of ball-point set screws 57, 57 are arranged opposite one another in the end faces 29, 30. The thrust balls of these ball-point set screws 57, 57 engage in the cover 2 through spherical holes 38, 39 having a center bore 61 and maintain the cover 2 in the open position. This cleaning position is shown in broken lines in FIG. 2. It may also be sufficient to have only a single ball-point set screw in one of the two end faces to arrest and secure the opened cover 2.

In order to secure the casting channel 1 in its second cleaning position, a further pair of locking bolts 46, 46 is disposed in the swivel path 56 of the casting channel 1, at a close proximate distance from the pair of locking bolts 45, 45. Swivelling and fixing the casting channel 1 in its second cleaning position is carried out as described above in connection with the first cleaning position.

An additional pair of ball-point set screws 62 is disposed in the end faces 29, 30 and is slightly displaced with respect to the other pair of ball-point set screws. By means of these ball-point set screws, the opened cover can be secured in a position in which the gap between the casting channel 1 and the cover 2 is narrower than in the first cleaning position. It is, of course, also possible to have locking bolts instead of the ball-point set screws.

Figure 4:
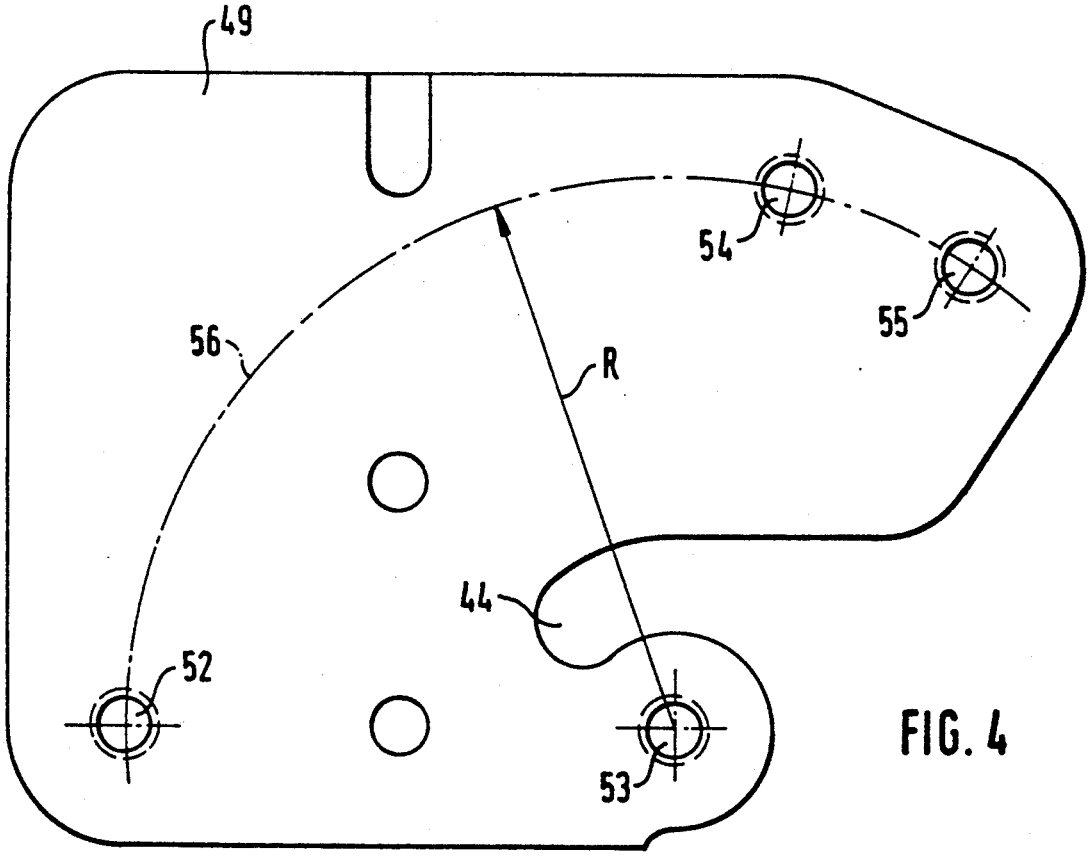
FIG. 4 shows a bearing plate of the mounting support used in the present invention.

In the outside view of the bearing plate 49 according to FIG. 4, the swivel path 56 of the casting channel 1 is indicated by a broken line. Holes 54, 55 are arranged along this swivel path to accommodate locking bolts 45, 46 in the first and second cleaning positions of the casting channel 1. At the base of the swivel path 56, a hole 52 is provided, through which the locking bolt 35 passes and which, together with the locking bolt 36, secures the casting channel 1 in its working position. The locking bolt 36 penetrates a hole 53 in the bearing plate 49 and forms part of the bearing 3. In addition, the bearing plate 49 has a recess 44 that permits swivel movement of the locking bolt 58 that engages the cover 2 of the casting channel 1.

Figure 5A:
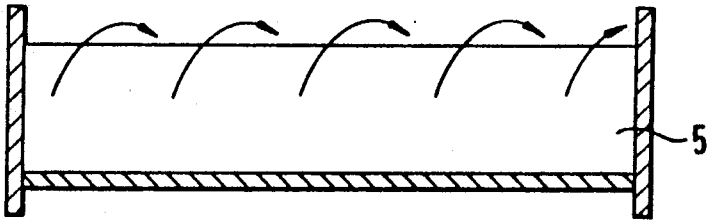
FIG. 5*a* shows an embodiment of an overflow baffle of the casting channel according to the present invention.
Figure 5B:
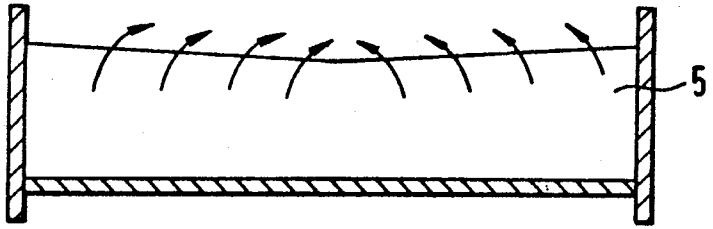
FIG. 5*b* shows an alternate embodiment of an overflow baffle of the casting channel according to the present invention.
Figure 5C:
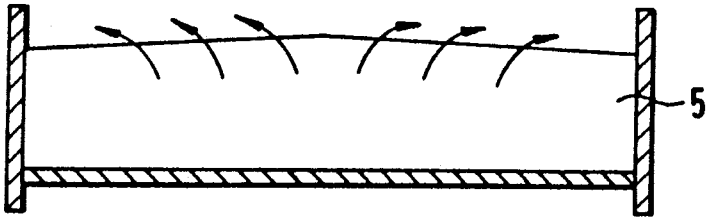
FIG. 5*c* shows another embodiment of an overflow baffle of the casting channel according to the present invention.

FIGS. 5*a*, 5*b*, and 5*c* are diagrammatic views of various embodiments of the overflow baffle 5 of the casting channel 1. As shown in these figures, the overflow baffle 5 can be designed in such a way that its bottom edge sits closely against the inside wall of the casting channel 1. In the embodiment according to FIG. 5*a*, the upper edge of the overflow baffle 5 is straight, while the upper edge of the overflow baffle 5 according to FIG. 5*b* is bent such that its upper edge droops from the sides of the overflow baffle 5 towards the middle, and the upper edge of the overflow baffle 5 according to FIG. 5*c* is bent such that, from an apex in the middle of the overflow baffle 5, it droops on either side towards the end faces of the casting channel. Due to this geometry or configuration of the baffle in the embodiments shown in FIGS. 5*b* and 5*c*, a crosscurrent is produced in the coating material flowing over the overflow baffle 5.

Figure 6A:
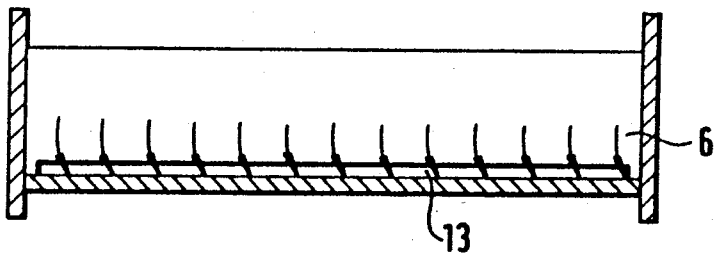
FIG. 6*a* shows an embodiment of an underflow baffle of the casting channel of the present invention.
Figure 6B:
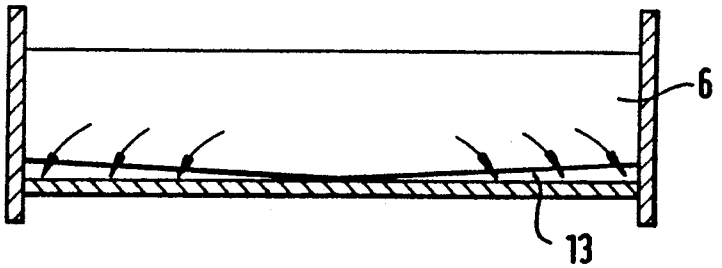
FIG. 6*b* shows an alternate embodiment of an underflow baffle of the casting channel of the present invention.
Figure 6C:
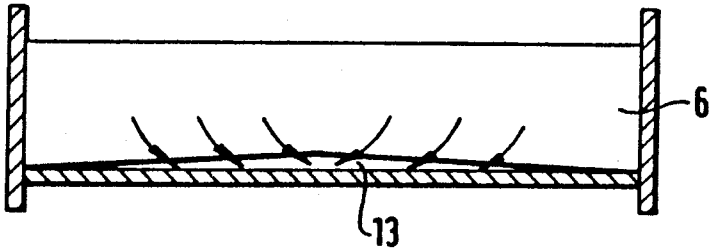
FIG. 6*c* shows another alternate embodiment of an underflow baffle of the casting channel of the present invention.

FIGS. 6*a*, 6*b* and 6*c* represent various embodiments of the underflow baffle 6 of the casting channel 1. The underflow baffle 6 is constructed to leave a slot between the casting channel 1 and the bottom edge of the underflow baffle 6, after the underflow baffle 6 has been inserted in a groove in the casting channel 1. The coating material flows through this slot without streaming over the upper edge of the underflow baffle 6. In the embodiment shown in FIG. 6*a*, the slot between casting channel and bottom edge of the underflow baffle 6 extends parallel. In the embodiment shown in FIG. 6*b*, the slot is designed as an opening widening from the middle towards the sides. In contrast, in the embodiment shown in FIG. 6*c*, the slot opening widens from the sides of the underflow baffle towards its middle. As in the case of the overflow baffles shown in FIGS. 5*b* and 5*c*, a cross current in the coating material supply is produced by these inclined slot configurations of the underflow baffles. To intensify the effect of cross-current, the embodiments of the underflow baffle 6 shown in FIGS. 6*b* and 6*c* can be combined with the embodiments shown in FIGS. 5*b* or 5*c* of the overflow baffle 5.

The overflow baffle 5 and also the underflow baffle 6 improve the separation of air bubbles which are carried along in the coating material stream and which are entrained, for example, when the coating material curtain flows into the draining trough 16 or into the supply tank 22 and are entrapped in the coating material. Due to the high viscosities of the coating materials, for example as in the case of casting varnishes, it takes a long time for small air bubbles to be released and separated at the air-liquid interface at the surface of the coating material stock.

For partially degassing the coating material, the supply tank 22 can be provided with a conical cross-section (not shown), in which the inclined walls converge conically in the downward direction. The coating material runs slowly down these inclined walls as a thin film and is consequently already partially degassed when it reaches the coating material stock. Another possibility of degassing the coating material is to place an insert in the form of a conical hollow body in the supply tank 22 having, for example, a cylindrical cross-section, whereby the coating material runs slowly down the conical hollow insert as a thin film and is degassed in the process. The conical hollow insert floats on the surface of the coating material and is thus automatically raised and lowered with the filling level in the supply tank. The surface of the conical insert, which is not shown, can be smooth or rough, for example, fluted. Due to roughening of the surface, the surface area of conical insert is increased, and the coating material flowing down over this surface is thinned in places such that air bubbles can be more readily released and escape from the coating material. At the same time, the inlet cone in the supply tank protects the coating material from the evaporation of solvent.

The embodiments of the underflow baffle 6 shown in FIGS. 6*a*, 6*b*, and 6*c* also act as separating walls which retain air bubbles carried along in the coating material stream. In the three embodiments of the underflow baffle 6 shown in these figures, coating material flows past on the underside, which prevents air bubbles entrained from the supply tank 22 or carried along in the coating material streaming into the casting channel 1 and rising up at the underflow baffle 6 from entering into the casting film 12. The height of the flow-through slot 13 of the underflow baffle 6 may be varied. For cleaning, both the overflow baffle and the underflow baffle can be removed from their mountings in the casting channel.

Instead of having overflow and underflow baffles with rigid walls, these separating walls for air bubbles can also be made of monolayer or multilayer fine-meshed sieve cloths, on which air bubbles are retained and transported to the coating material surface, while the coating material flows through the sieve cloth. In this case, the separating walls are flush with the bottom and the end faces of the casting channel 1, i.e., the coating material stream passes through or over, but cannot pass underneath, the sieve cloths. The sieve cloths serve, simultaneously, as filters to keep particles and contaminants which may get into the casting film or into the draining trough from the environment, directly away from the overflow edge of the casting channel 1. An additional filter, for example, a filtering candle or a flat filter, can then be dispensed with, thereby further reducing the cost and expense of cleaning.

What is claimed is:

1. A coating device comprising:

a coating material supply tank;

a casting channel having a cover;

a supply tube communicating with the casting channel;

a drainage trough; and a pump operatively associated with the coating material supply tank and the supply tube for pumping the coating material from the coating material supply tank to the supply tube;

wherein the casting channel comprises an open tubular section having an overflow edge and closed ends to form a bowl, disposed on a support for swivel movement about an axis of the tubular section, the drainage trough being provided beneath the overflow edge;

wherein the cover is disposed on a support for swivel movement about the axis of the tubular section, and the cover and the tubular section form a gap adjacent the overflow edge of the tubular section; and wherein the drainage trough is connected to the coating material supply tank.

2. A coating device as claimed in claim 1, wherein the casting channel and cover are disposed on a common support.

3. A coating device as claimed in claim 1, further comprising an overflow baffle and an underflow baffle which encloses a flow through slot with the inner side of the casting channel disposed in grooves in the casting channel to separate air bubbles from the coating material.

4. A coating device as claimed in claim 1, further comprising a casting plate having an edge-shaped casting lip disposed on the outside of the casting channel, below the overflow edge.

5. A coating device as claimed in claim 4, wherein the casting plate is made of a magnetic material and is held in place by magnets on the outside of the casting channel.

6. A coating device as claimed in claim 1, further comprising a gasket mounted on the side of the cover, opposite the overflow edge.

7. A coating device as claimed in claim 1, wherein the closed ends of the open tubular section are lateral end face plates.

8. A coating device as claimed in claim 7, wherein each lateral end face plate has locking and fitting screws with holes, which holes are engaged by locking bolts passing through bearing plates of the mounting support for securing the casting channel and the cover in its working position.

9. A coating device as claimed in claim 1, further comprising a connecting piece on the outside of the casting channel through which the supply tube is inserted, and a funnel over which a hose for the supply of the coating material is pushed.

10. The coating device as claimed in claim 3, wherein a bottom edge of the overflow baffle is integral with the inside wall of the casting channel and wherein an upper edge of the overflow baffle is straight.

11. The coating device as claimed in claim 10, wherein the upper edge of the overflow baffle droops from an apex in the middle of the casting channel length towards the closed ends.

12. The coating device as claimed in claim 3, wherein the overflow baffle has a straight bottom edge and a bent upper edge which rises obliquely from a bending point in the middle of the casting channel length towards the closed ends such that the coating material streaming into the casting channel flows over the overflow baffle to produce a cross current in the area of the upper-edge.

13. The coating device as claimed in claim 3, wherein the flow-through slot of the underflow baffle has a rectangular cross-section extending parallel over the length of the casting channel and wherein the upper edge of the underflow baffle extends straight and parallel to the bottom of the casting channel.

14. The coating device as claimed in claim 13, wherein the flow-through slot of the underflow baffle has a rectangular cross-section extending parallel to the bottom of the casting channel.

15. The coating device as claimed in claim 3, wherein the flow-through slot of the underflow baffle has a triangular cross-section, the lateral edges of which droop towards the closed ends of the casting channel and wherein the upper edge of the underflow baffle extends straight with respect to the bottom of the casting channel.

16. The coating device as claimed in claim 3, wherein the lateral edges rise obliquely towards the closed ends.

17. The coating device as claimed in claim 8, wherein each bearing plate of the mounting support has a curved recess in which locking bolts for engaging the cover in the closed position of the casting channel move during the swivel movement of the casting channel.

18. The coating device as claimed in claim 8, wherein at least one bearing plate of the mounting support is penetrated by two further locking bolts that engage in the hole of the locking and fitting screws of the end face and in the hole of the swivelled casting channel when the casting channel is swivelled into its first or second cleaning position.

19. The coating device as claimed in claim 1, further comprising a conical hollow body having inclined surfaces provided in the drainage trough over the inclined surfaces of which the coating material flows down as a thin film and is degassed in the process.

* * * * *